United States Patent [19]

Hisamoto et al.

[11] Patent Number: 4,606,832

[45] Date of Patent: Aug. 19, 1986

[54] FIRE EXTINGUISHING COMPOSITION

[75] Inventors: Iwao Hisamoto, Osaka; Chiaki Maeda; Takasige Esaka, both of Kyoto; Masaru Hirai, Osaka, all of Japan

[73] Assignee: Daikin Kogyo Company, Limited, Osaka, Japan

[21] Appl. No.: 548,697

[22] Filed: Nov. 4, 1983

[30] Foreign Application Priority Data

Nov. 10, 1982 [JP] Japan ..... 57-198139

[51] Int. Cl.[4] ..... A62D 1/00

[52] U.S. Cl. ..... 252/8; 169/46; 169/47; 169/54; 169/65; 252/2; 252/3

[58] Field of Search ..... 252/2, 8, 3, 7; 169/44, 169/46, 47, 65, 54

[56] References Cited

U.S. PATENT DOCUMENTS

| | | | |
|---|---|---|---|
| 3,479,286 | 11/1969 | Gambaretto et al. | 252/8 |
| 3,715,438 | 2/1973 | Huggett | 252/8 |
| 3,957,658 | 5/1976 | Chiesa, Jr. et al. | 252/8 |
| 4,014,799 | 3/1977 | Owens | 252/8 |
| 4,069,872 | 1/1978 | Lassen | 252/2 |
| 4,226,727 | 10/1980 | Tarpley, Jr. et al. | 252/8 |
| 4,226,728 | 10/1980 | Kung | 252/8 |
| 4,390,069 | 6/1983 | Rose, Jr. | 252/3 |
| 4,402,364 | 9/1983 | Klein | 252/2 |

*Primary Examiner*—Stephen J. Lechert, Jr.
*Assistant Examiner*—Howard J. Locker
*Attorney, Agent, or Firm*—Murray and Whisenhunt

[57] ABSTRACT

A fire extinguishing composition which comprises bromofluorohydrocarbon and/or bromochlorofluorohydrocarbon and a fluorine-containing high molecular compound.

6 Claims, No Drawings

FIRE EXTINGUISHING COMPOSITION

This invention relates to a fire extinguishing composition.

Against kitchen fires, particularly a fire of frying oil, there is known no effective fire extinguishing agents or compositions as practically available to put out the fire in which the oil is heated to above the ignition point. The reason is that known pumped foam fire extinguishing composition can be easily applied to big-scale fires, e.g., in plants but difficultly applied to small-scale fires such as kitchen fire because an aqueous composition in the fire extinguishing composition repulses the burning frying oil to an inflammable article, making it impossible to easily give its fire extinguishing effect.

Generally, bromofluorohydrocarbon and/or bromochlorofluorohydrocarbon (hereinafter referred to as "Halon") are known to be effective extinguishing agents against a fire of oil and electric instrument fire, etc. However, the Halons have a disadvantage that the remaining inflammables tend to reignite when embers remain or when the temperature of the oil exceeds the ignition agent.

An object of the invention is to provide a novel fire extinguishing composition which comprises a Halon and is free from the above disadvantage.

Another object of the invention is to provide a fire extinguishing method in which the above novel composition is applied to a fire of oil.

According to the invention, the above mentioned objects are accomplished by a fire extinguishing composition which comprises a Halon and a fluorine-containing high molecular compound.

The composition of the invention can put out the fire quickly and completely by forming a layer on the surface of the oil and choking the fire. Thus, reignition can be prevented. Further, also in the case of the petroleum fire caused by a kerosene heater etc., the reignition due to very little embers can be prevented. In addition, embers are completely put out also in the fire of lumber, etc. and the reburning in prevented.

The fluorine-containing high molecular compound of the invention can be a high molecular compound having polyfluoroalkyl groups or polyfluoroalkyl poly(oxyalkylene)-alkyl groups such as straight or branched perfluoroalkyl groups, ω-hydro-perfluoroalkyl groups, perfluoroalkyl-poly(perfluoroxyalkylene)perfluoroxyalkyl groups, perfluoroalkyl-poly(perfluoroxyalkylene)oxyalkyl groups.

Preferable fluorine-containing high molecular compounds of the invention are those containing at least 10% by weight of fluorine, since a heat resistant and tough film is formed on the oil surface and the reignition or reburning from embers is effectively prevented.

The fluorine-containing high molecular compound has an average molecular weight of not less than 5,000.preferably not less than 10,000. When the average molecular weight is less than 5,000, any effective layer is not formed on the surface of the oil.

Examples of preferable fluorine-containing high molecular compounds of the invention are those having a perfluoroalkyl group. Specific examples are a homopolymer of an ethylenically unsaturated compound having a perfluoroalkyl group and at least one group selected from a (meth)acrylate group, vinyl group and vinyloxy group; a copolymer of the above ethylenically unsaturated compound and an other copolymerizable monomer having no fluorine; and a compound obtained by reacting a high molecular compound having a functional group but containing no fluorine with an alcohol, amine; carboxylic acid or epoxy compound having a perfluoroalkyl group, etc.

Examples of the above ethylenically unsaturated compounds having a perfluoroalkyl group and at least one group selected from a (meth)acrylate group, vinyl group and vinyloxy group are:

$Rf\ (CH_2)_nOCOCR^1{=}CH_2$ $Rf\ SO_2N(R^2)R^3OCOCR^1{=}CH_2$ $Rf\ CON(R^2)R^3OCOCR^1{=}CH_2$ $Rf\ (CH_2)_nCH(OH)CH_2OCOCR^1{=}CH_2$ $Rf\ (CH_2)_nCH(OCOR^4)CH_2OCOCR^1{=}CH_2$ $Rf\ CH{=}CH(CH_2)_nOCOCR^1{=}CH_2$ $Rf\ (CH_2)_nCH{=}CH_2$ $Rf\ (CH_2)_nOCH{=}CH_2$ $Rf\ (CH_2)_nNH_3OCOCR^1{=}CH_2$ $Rf\ (CH_2)_nNHCH_2CH(OH)CH_2OCOCR^1{=}CH_2$ $Rf\ (CH_2)_{n-1}COOCH_2CH(OH)CH_2OCOCR^1{=}CH_2$ $Rf\ (CH_2)OCOCH{=}CHCOOR^2$ wherein Rf is a perfluoroalkyl group having 4 to 21 carbon atoms, $R^1$is a hydrogen atom or methyl group, $R^2$ is a hydrogen atom or alkyl group having 1 to 10 carbon atoms, $R^3$ is an alkylene group having 1 to 10 carbon atoms, $R^4$ n is an integer of 1 to 10.

Examples of the other copolymerizable monomers having no fluorine include acrylic acid, methacrylic acid, alkyl($C_{1\sim20}$) ester of acrylic acid or methacrylic acid, methoxypolyethylene glycol ester, polypropylene glycol ester, glycidyl acrylate, glycidyl methacrylate, acrylonitrile, methacrylonitrile, acrylamide, methacrylamide, N-methylol- acrylamide, N-methylolmethacrylamide, alkyl($C_{1\sim5}$) vinyl ether, vinyl acetate, vinylpyrrolidone, vinylacetamide, styrene, maleic anhydride, butadiene, etc.

Examples of the high molecular compound having a functional group but containing no fluorine are:

(A) a homopolymer of maleic anhydride or copolymer with an other copolymerizable monomer having no fluorine, (B) a homopolymer of (meth)acrylic acid or copolymer with an other copolymerizable monomer having no fluorine, (C) a homopolymer of glycidyl (meth)acrylate or copolymer with an other copolymerizable monomer having no fluorine, etc.

As a fluorine-introducing compound is used an alcohol, amine, carboxylic acid or epoxy compound having a perfluoroalkyl group.

In case the above homopolymer or copolymer (A) is used, an amine of the formula below may be used:

$Rf(CH_2)_nNH_2$ n: 1~10

In case the homopolymer or copolymer (B) is used, and alcohol, amine or epoxy compound having the formulae below may be used:

$Rf(CH_2)_nOH$ $Rf(CH_2)_nNH_2$

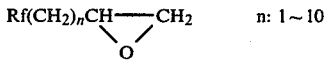

n: 1~10

Further, in case the homopolymer or copolymer of (C) is used, an amine or carboxylic acid of the formulae below may be used:

$Rf(CH_2)_nNH_2$
$Rf(CH_2)_{n-1}COOH$ n: same as above

Specific examples of fluorine-containing high molecular compounds are as follows:

A copolymer of $C_8F_{17}CH_2CH(OH)CH_2OOCCH{=}CH_2$ (A), octyl methacrylate and N-methylolacrylamide A copolymer of the above (A), stearyl acylate and acrylamide A copolymer of $C_3F_{19}CH_2CH_2OOCC(CH_3){=}CH_2$ (B), glycidyl methacrylate and methyl acrylate A copolymer of the above (B), styrene and vinylpyrrolidone A copolymer of $C_9F_{19}SO_2N(CH_3)C_2H_4OOCCH{=}CH_2$ (C) and $CH_3O(C_2H_4O)_9OCCH{=}CH_2$ A compound obtained by reacting a copolymer of butyl vinyl ether and maleic anhydride with $C_7F_{15}CH_2CH_2OH$ and ethanol, having recurring units:

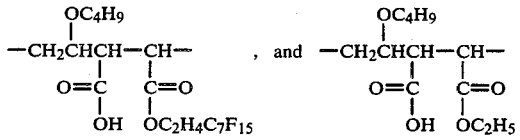

A compound obtained by reacting a copolymer of glycidyl methacrylate and lauryl acrylate with $C_{11}F_{23}CH_2CH_2NH_2$, having recurring units:

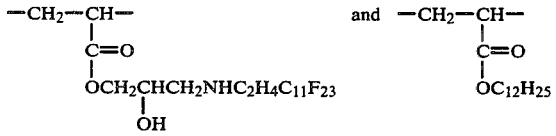

Preferable fluorine-containing high molecular compounds of the invention are those soluble in the above Halon in the absence or presence of an incombustible solvent, and specifically those having a solubility of more than 0.5% by weight in the Halon.

Although these high molecular compounds can be prepared by a known process, particularly preferable are those obtained by a solution polymerization in view of solubility.

Examples of preferable Halons are bromofluorohydrocarbons or bromochlorofluorohydrocarbons having 1 to 2 carbon atoms. Examples of such Halons are bromotrifluoromethane (Halon-1301, $CF_3Br$), dibromotetrafluoroethane (Halon-2404, $C_2F_4Br_2$), bromochlorodifluoromethane (Halon-1211, $CF_2BrCl$), dibromochlorofluoromethane, bromodichlorofluoromethane, dibromodifluoromethane, dibromochlootriflouoroethane, dibromodichlorodifluoroethane, dibromohexafluoropropane, etc.

Examples of incombustible solvents which may be used as required to enhance solubility of the high molecular compound include trichlorofluoromethane (Flon 11), trichlorotrifluoroethane (Flon 113), tetrachlorodifluoroethane (Flon 112), chlorobromomethane, dichloromethane, trichloroethane, tetrachloroethylene, etc. The incombustible solvent can be added in an amount of usually up to 20% by weight based on a total amount of the fire extinguishing composition. As required, added are alcohols, cellosolves and like inflammable solvent, water, surfactants, etc. , in an amount of up to 5% by weight based on a total amount of the fire extinguishing composition.

In the invention, the high molecular compound is added in the composition in an amount of 0.5 to 40% by weight, preferably 1 to 20% by weight, and the Halon is added in the composition in an amount of preferably at least 50% by weight.

The fire extinguishing composition of the invention can be obtained by mixing components stated above. For example, chlorofluorohydrocarbon, fluoro-hydrocarbon or compressible gas such as carbon dioxide may be added as required to make aerosol or a fire extinguisher. Furthermore, said components may be sealed into resin bags or glass bulbs for throwing into the fire. As chlorofluorohydrocarbon or fluorohydrocarbon used to make aerosol, preferable are hydrocarbons having 1 to 2 carbon atoms in which at least one hydrogen atom is substituted by fluorine atom and as required is further substituted by chlorine atom. Examples thereof are chlorodifluoromethane, dichlorodifluoromethane, dichlorotetrafluoroethane, etc.

The invention will be described below in detail with reference to Examples and Comparison Examples.

EXAMPLE 1

As a high molecular compound was used a compolymer of $C_8F_{17}CH_2CH(OH)CH_2OOCCH{=}CH_2$, stearyl acrylate and acylamide in a weight ratio of 3:1:1. The above compound (20 g) and 320 g of $C_2F_4Br_2$ were placed into a 5-liter stainless steel pressure resistant vessel having a valve and an opening, and the opening was closed. After 80 g of $CF_3Br$ was added to the vessel through the valve, the valve was closed. The vessel was then shaked to dissolve the high molecular compound. The valve was connected to the aerosol container, from which 300 g of the mixture was transferred into a 16 oz. aerosol can.

EXAMPLE 2

A fire extinguishing composition was prepared in the same manner as in Example 1 with use of 8 g of a copolymer of $C_9F_{19}C_2H_4OOCCH{=}CH_2$, styrene and vinylpyrrolidone in a weight ratio of 2:1:1, as a high molecular compound.

EXAMPLE 3

A fire extinguishing composition was prepared in the same manner as in Example 1 with use of 20 g of a copolymer of $C_9F_{19}SO_2N(CH_3)C_2H_4OCOCH{=}CH_2$ and $CH_3O(C_2H_4O)_9COCH{=}CH_2$ in a weight ratio of 3:1, as a high molecular compound.

EXAMPLE 4

A fire extinguishing composition was prepared in the same manner as in Example 1 with use of 20 g of a copolymer of $C_8F_{17}CH_2CH(OCOCH_3)CH_2OCOC(CH_3){=}CH_2$, $C_8H_{17}OCOC(CH_3){=}CH_2$ and $CH_2{=}CHCONHCH_2OH$ in a weight ratio of 3:1:1, as a high molecular compound.

EXAMPLE 5

A fire extinguishing composition was prepared in the same manner as in Example 1 with use of 20 g of a compound obtained by reacting 2 weight parts of a copolymer of maleic anhydride and butyl vinyl ether (weight ratio, 1:1) with 2 weight parts of $C_7F_{15}C_2H_4OH$ and 0.2 part of $C_2H_5OH$, as a high molecular compound.

Comparison Example 1

A fire extinguishing composition was prepared in the same manner as in Example 1 except that the high molecular compound was not used.

Extingushing Test

Into an aluminum pot (inside diameter of 160 mm and 90 mm high) equipped with a thermoelectric thermometer was placed 0.2 liter of rapeseed oil and the pot is heated on a propane gas heater until the rapeseed oil has ignited at the spontaneous ignition temperature of about 380° C., and the fire extinguishing compositions of Examples and Comparison Example were applied to the center of the oil surface for 10 seconds.

The time from the application of the composition to complete extinguishing of the fire was measured as the fire extinguishing time. The amount of the fire extinguishing composition applied to for 10 seconds was measured by weighing the remaining amount of the composition.

The heater was put off at the same time the rapeseed oil fire was extinguished and allowed for 2 minutes, and observation was made whether reignition occured or not. The results were given in Table 1.

TABLE 1

| | fire extinguishing time (sec) | amount of composition (g) | reignition |
|---|---|---|---|
| Example 1 | <2 | 201 | No |
| Example 2 | <2 | 200 | No |
| Example 3 | <2 | 198 | No |
| Example 4 | <2 | 200 | No |
| Example 5 | <2 | 202 | No |
| Com. Ex. 1 | <2 | 202 | Yes* |

*4 seconds after fire extinguishing

We claim:

1. A fire extinguishing composition which comprises at least 50% by weight of bromofluorohydrocarbon and/or bromochlorofluorohydrocarbon and 0.5 to 40% by weight of a fluorine-containing high molecular compound, wherein said fluorine-containing high molecular compound has an average molecular weight of not less than 5,000 said fluorine-containing high molecular compound is a compound having a perfluoroalkyl group, and said fluorine-containing high molecular compound contains fluorine in an amount of at least 10% by weight.

2. A fire extinguishing composition as defined in claim 1, wherein the fluorine-containing high molecular compound is a homopolymer of an ethylenically unsaturated compound having a perfluoroalkyl group and at least one group selected to a (meth)acrylate group, vinyl group and vinyloxy group; a copolymer of the above ethylenically unsaturated compound and an other copolymeriazble monomer having no fluorine.

3. A fire extinguishing composition as defined in claim 1, wherein the fluorine-containing high molecular compound is a compound obtained by reacting a high molecular compound having a functional group but containing no fluorine with an alcohol, amine, carboxylic acid or epoxy compound having a perfluoroalkyl group.

4. A fire extinguishing composition as defined in claim 2, wherein the ethylenically unsaturated compound having a perfluoroalkyl group and at least one group selected from a (meth)acrylate group, vinyl group and vinyloxy group are:

$Rf(CH_2)_nOCOCR^1{=}CH_2$ $RfSO_2N(R^2)R^3OCOCR^1{=}CH_2$ $RfCON(R^2)R^3OCOCR^1{=}CH_2$ $Rf(CH_2)_nCH(OH)CH_2OCOCR^1{=}CH_2$ $Rf(CH_2)_nCH(OCOR^4)CH_2OCOCR^1{=}CH_2$ $RfCH{=}CH(CH_2)_nOCOCR^1{=}CH_2$ $Rf(CH_2)_nCH{=}CH_2$ $Rf(CH_2)_nOCH{=}CH_2$ $Rf(CH_2)_nNH_3OCOCR^1{=}CH_2$ $Rf(CH_2)_nNHCH_2CH(OH)CH_2OCOCR^1{=}CH_2$ $Rf(CH_2)n{-}1COOCH_2CH(OH)CH_2OCOCR^1{=}CH_2$ $Rf(CH_2)OCOCH{=}CHCOOR^2$ wherein Rf is a perfluoroalkyl group having 4 to 21 carbon atoms, $R^1$ is a hydrogen atom or methyl group, $R^2$ is a hydrogen atom or alkyl group having 1 to 10 carbon atoms, $R^3$ is an alkylene group having 1 to 10 carbon atoms, $R^4$ is an alkyl group, and n is an integer of 1 to 10.

5. A fire extinguishing composition as defined in claim 1, wherein the fluorine-containing high molecular compound is soluble in the bromofluorohydrocarbon and/or bromochlorofluorohydrocarbon in an amount of at least 0.5% by weight.

6. A fire extinguishing method in which the composition of claim 1 is applied to a fire of oil.

* * * * *